US007170507B2

(12) United States Patent
Sase

(10) Patent No.: US 7,170,507 B2
(45) Date of Patent: Jan. 30, 2007

(54) LIQUID CRYSTAL DRIVING SEMICONDUCTOR CHIP

(75) Inventor: Ichiro Sase, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 453 days.

(21) Appl. No.: 10/807,135

(22) Filed: Mar. 24, 2004

(65) Prior Publication Data

US 2005/0099380 A1 May 12, 2005

(30) Foreign Application Priority Data

Nov. 6, 2003 (JP) ..... 2003-377042

(51) Int. Cl.
*G09G 3/36* (2006.01)

(52) U.S. Cl. ..... 345/211; 345/98; 345/204

(58) Field of Classification Search ..... 345/211, 345/204, 87–104
See application file for complete search history.

(56) References Cited

U.S. PATENT DOCUMENTS 5,532,718 A * 7/1996 Ishimaru ..... 345/211
6,633,274 B1 * 10/2003 Yokota et al. ..... 345/100

FOREIGN PATENT DOCUMENTS

JP 08-22267 1/1996
JP 08-22268 1/1996

* cited by examiner

*Primary Examiner*—Lun-Yi Lao
(74) *Attorney, Agent, or Firm*—Nixon Peabody LLP; Donald R. Studebaker

(57) ABSTRACT

Disclosed is a liquid crystal driving semiconductor chip capable of preventing an electrostatic-surge originated malfunction. A monitor electrode for monitoring the ground potential of an external power supply circuit is provided as separate from a ground electrode 16 for power supply, the logical level of the monitor electrode is detected by an NMOS transistor in a level monitor section and a NAND gate is controlled by the detected signal. When the ground potential in the semiconductor chip drops due to, for example, a negative electrostatic surge, the logical level of the monitor electrode increases relatively to turn the NMOS transistor on, thereby setting the detected signal to "L". As a result, the NAND gate is closed so that an enable signal from a control electrode stops being supplied to a control section, thereby preventing a malfunction originating from the erroneous enable signal.

4 Claims, 6 Drawing Sheets

LIQUID CRYSTAL DRIVING SEMICONDUCTOR CHIP

BACKGROUND OF THE INVENTION

1. Field of the Invention

The present invention relates to a technique for preventing the electrostatic-surge oriented malfunction of a liquid crystal driving semiconductor chip which is to be mounted on a liquid crystal display panel (hereinafter referred to as "LCD").

2. Description of the Related Art

An LCD is constructed by a segment-side glass plate on which a plurality of segment electrodes are formed in parallel in the vertical direction, for example, laying out a common-side glass plate, on which a plurality of common electrodes are formed in parallel in the horizontal direction, in such a way as to face the segment-side glass plate and filling a liquid crystal between the glass plates. The LCD performs display by using the property that as an electric field is applied between the segment electrode and common electrode, the direction of the liquid crystal between them is aligned to change the light transmissivity. As the segment electrodes and common electrodes should transmit light, they are formed of a material having both light transmissivity and electric conductivity in the form of thin films on the respective glass plates. A COG (Chip on Glass) type LCD has a liquid crystal driving IC (Integrated Circuit) chip mounted on a glass plate of a small LCD which is used for a watch, electric calculator or so.

FIG. 1 is a conceptual diagram of a COG type LCD.

This COG type LCD has an IC chip mounted on an extended segment-side glass plate of an LCD which has the segment-side glass plate and a common-side glass plate facing each other with a liquid crystal in between. Segment electrodes are extended to the electrodes of the IC chip by a segment wiring pattern formed of the same thin film material on the glass plate. Further, connector electrodes are formed on one side of the segment-side glass plate for connection to an external computer or so by a connector and wirings to connect the connector electrodes to the electrodes of the IC chip are also formed of the same thin film material as that of the segment electrodes on the glass plate by means of a lead wiring pattern.

FIGS. 2*a* and 2*b* are structural diagrams of a conventional liquid crystal driving IC chip to be used in the COG type LCD.

This liquid crystal driving IC chip 10 is to be mounted in the COG manner on, for example, the segment-side glass plate of an LCD. As apparent from the general structure in FIG. 2*a*, the IC chip 10 has a power-supply electrode 11 to connect to a connector electrode 1 formed on a segment-side glass plate, a plurality of address electrodes 12, a control electrode 13, a plurality of data electrodes 14, an enable electrode 15 and a ground electrode 16.

The power-supply electrode 11 is supplied with a power supply voltage VDD from an external computer or so. The address electrodes 12 are supplied with an address signal ADR from the computer for temporarily storage of display data. The control electrode 13 is supplied with a read/write control signal R/W from the computer. The data electrodes 14 are used to input and output a data signal DT to from the computer in parallel. The enable electrode 15 is supplied from the computer with an enable signal EN which indicates the enableness of the operation. The ground electrode 16 is connected to a reference potential for the computer, i.e., a ground potential GND.

The IC chip 10 further has a plurality of drive electrodes 17 for outputting a display drive voltage to the individual segment electrodes of a liquid crystal display section 2 and a plurality of drive electrodes 18 for outputting a scan drive voltage to scan the common electrodes of the liquid crystal display section 2 sequentially.

The address electrodes 12, the control electrode 13, the data electrodes 14 and the enable electrode 15 are connected to a control section 30, which controls the general operation of the IC chip 10, via a buffer 21, a buffer inverter 22, a bidirectional buffer 23 and a buffer inverter 24, respectively. Connected to the control section 30 is a RAM (Random Access Memory) 40 which stores display data. A display signal generating section 50 which generates display signals corresponding to the individual segment electrodes of the liquid crystal display section 2 is connected to the data output side of the RAM 40. Also connected to the control section 30 is a common signal generating section 60 which generates a common signal to scan the connector electrodes of the liquid crystal display section 2 sequentially.

The output side of the display signal generating section 50 is connected to the drive electrodes 17 via a plurality of drive sections 70S which generate display drive voltages, based on the display signals, to drive the respective segment electrodes in the AC manner. The output side of the common signal generating section 60 is connected to the drive electrodes 18 via a plurality of drive sections 70C which generate display drive voltages, based on the display signals, to drive the respective common electrodes in the AC manner.

Further, the IC chip 10 has a drive voltage generating section 80 which generates drive voltages V1 and V2 for AC-driving the liquid crystal display section 2 from a chip power supply voltage VDD-C supplied from the connector electrode 1. The drive voltages V1 and V2 are commonly supplied to the individual drive sections 70S and 70C.

The individual electrodes 11 to 16 of the IC chip 10 are connected to the connector electrode 1 via the lead wiring pattern formed on the segment-side glass plate as shown in FIG. 1. The individual electrodes 17 and 18 are connected to the liquid crystal display section 2 via the segment wiring pattern and a common wiring pattern both formed on the segment-side glass plate as shown in FIG. 1.

The drive section 70S comprises a predriver 71, four switches 72 to 75 and protective diodes 76 and 77, as exemplified in, for example, FIG. 2*b*. The predriver 71 outputs select signals SL1 to SL4 each for selecting an associated one of the four drive voltages VDD-C, V1, V2 and GND-C based on a display signal given from the display signal generating section 50 and a frame signal for AC-driving The switches 72 to 75 output drive voltages according to the select signals SL1 to SL4 and their output sides are connected to the corresponding drive electrodes 17. The protective diodes 76 and 77 serve to prevent the IC chip 10 from being damaged by the electrostatic surge that enter through the segment electrodes and common electrodes of the liquid crystal display section 2 and are connected between the drive electrode 17 and the power supply voltage VDD-C and the ground potential GND-C in the reverse directions with the normal operational voltage applied. The structure of the drive section 70C is the same as that of the drive section 70S.

The operation is discussed below.

First, as the power supply voltage is supplied to the power-supply electrode 11 and the ground electrode 16 of the liquid crystal driving IC chip 10 through the connector electrode 1, the power supply voltage VDD-C and the ground potential GND-C are supplied to the individual sections of the IC chip 10. Then, the drive voltage generating section 80 generates the drive voltages V1 and V2 and supply them to the respective drive sections 70S and 70C.

Data to be displayed on the liquid crystal display section 2 is given to the connector electrode 1 from an external computer. That is, the read/write control signal R/W to be given to the control electrode 13 is set to an "L" level which indicates writing. Then, the address signal ADR that designates the memory position in the RAM 40 is given to the associated address electrode 12 and the display signal DT to write data at the memory position is given to the associated data electrode 14. When the enable signal EN to be supplied to the enable electrode 15 is set to an "H" level under the situation, the display data is written at the designated address in the RAM 40. When the enable signal EN is "L", the writing operation to the RAM 40 is inhibited.

The display data written in the RAM 40 is cyclically read out in order and supplied to the display signal generating section 50 under the control of the control section 30. The display signal generating section 50 generates display signals based on the display data read from the RAM 40 and supplies the display signals to the associated drive sections 70S.

In synchronism with the data reading from the RAM 40, the common signal generating section 60 generates a common signal to sequentially scan the common electrodes and supplies the signal to the drive sections 70C.

Accordingly, the drive sections 70C cyclically drive the common electrodes of the liquid crystal display section 2 in order, the display signal generating section 50 generates display information corresponding to the driven common electrodes and the drive sections 70S drive the respective segment electrodes. As a result, the liquid crystal display section 2 achieves matrix display according to the invention the display data stored in the RAM 40.

The IC chip 10 however has the following problem.

When a finger or so carrying static electricity touches the glass plate of the liquid crystal display section 2, for example, an electrostatic surge is applied to the segment electrodes or so via the glass plate. The applied electrostatic surge is transmitted to the drive electrodes 17 of the IC chip 10 through the segment wiring pattern on the top surface of the segment-side glass plate and then penetrates the drive sections 70S.

In case where the electrostatic surge has a negative polarity, the protective diode 77 in the drive section 70S is in the forward direction, so that the ground potential GND-C of the IC chip 10 is attracted toward the negative side. The ground potential GND-C is connected to the connector electrode 1 from the ground electrode 16 via the lead wiring pattern and is further connected to the ground potential GND of the external computer via the connector. Therefore, the negative electrostatic surge applied to the glass plate causes a surge current to flow to the finger or so from the ground potential GND of the external computer through the connector electrode 1, the lead wiring pattern on the segment-side glass plate, the ground electrode 16, the protective diode 77 and the segment wiring pattern.

As the lead wiring pattern on the segment-side glass plate, like the segment electrodes of the liquid crystal display section 2, is formed into a thin film pattern using a material which has both light transmissivity and electric conductivity, it has a relatively large resistance of about several hundred ohms. Therefore, the voltage drop caused by the surge current flowing to the lead wiring pattern makes the ground potential GND-C of the IC chip 10 lower than the ground potential GND of the external computer.

As the surge current does not flow to the lead wiring pattern that connects the enable electrode 15 to the connector electrode 1, on the other hand, the level of the enable signal EN of the enable electrode 15 is nearly the same as the level of the enable signal which is output from the external computer. In the IC chip 10, therefore, the level of the enable signal EN becomes relatively high as compared with the ground potential GND-C and may be determined as "H" although the level is "L". While the operation is prohibited by the external computer, therefore, the IC chip 10 malfunctions to rewrite data in the RAM 40 so that the proper screen display cannot be accomplished.

SUMMARY OF THE INVENTION

Accordingly, it is an object of the invention to provide a liquid crystal driving IC chip capable of preventing an electrostatic-surge originated malfunction. A liquid crystal driving semiconductor chip according to the first aspect of the invention comprises a control section which stores display data into a memory section in accordance with an operation control signal; a drive section which drives a liquid crystal display in accordance with the display data stored in the memory section; a power-supply electrode to which power is supplied from an external power supply circuit; a monitor electrode which is supplied with a power supply potential of the power supply circuit in a path different from a path for the power supplied from the power supply circuit; a control electrode to be supplied with a control signal to enable an operation of the control section; a CMOS inverter which detects a logical level of the control signal to be supplied to the control electrode; and a level monitor section which has an MOS transistor for detecting a logical level of the power supply potential to be supplied to the monitor electrode, outputs a detection signal from the CMOS inverter to the control section as the operation control signal when the MOS transistor detects a correct logical level, and stops outputting the operation control signal when the MOS transistor does not detect the correct logical level.

A liquid crystal driving semiconductor chip according to the second aspect of the invention comprises a control section which stores display data into a memory section in accordance with an operation control signal; a drive section which drives a liquid crystal display in accordance with the display data stored in the memory section; a first control electrode to be supplied with a first control signal to enable an operation of the control section; a second control electrode to be supplied with a second control signal which is the first control signal whose logical level is inverted; a first CMOS inverter which detects a logical level of the first control signal to be supplied to the first control electrode; and a level monitor section which has a second CMOS inverter which detects a logical level of the second control signal to be supplied to the second control electrode, outputs a detection signal from the first CMOS inverter to the control section as the operation control signal when a logical level of a signal obtained by inverting a detection signal from the first CMOS inverter coincides with a logical level of a detection signal from the second CMOS inverter, and stops outputting the operation control signal when the logical levels do not match with each other.

DETAILED DESCRIPTION OF THE PREFERRED EMBODIMENTS

The object of the present invention and other objects and novel features thereof may best be understood by reference to the following description of the presently preferred embodiments together with the accompanying drawings. The drawings are however given mainly to be illustrative and do not limit the scope of the invention.

(First Embodiment)

Figure 2A:
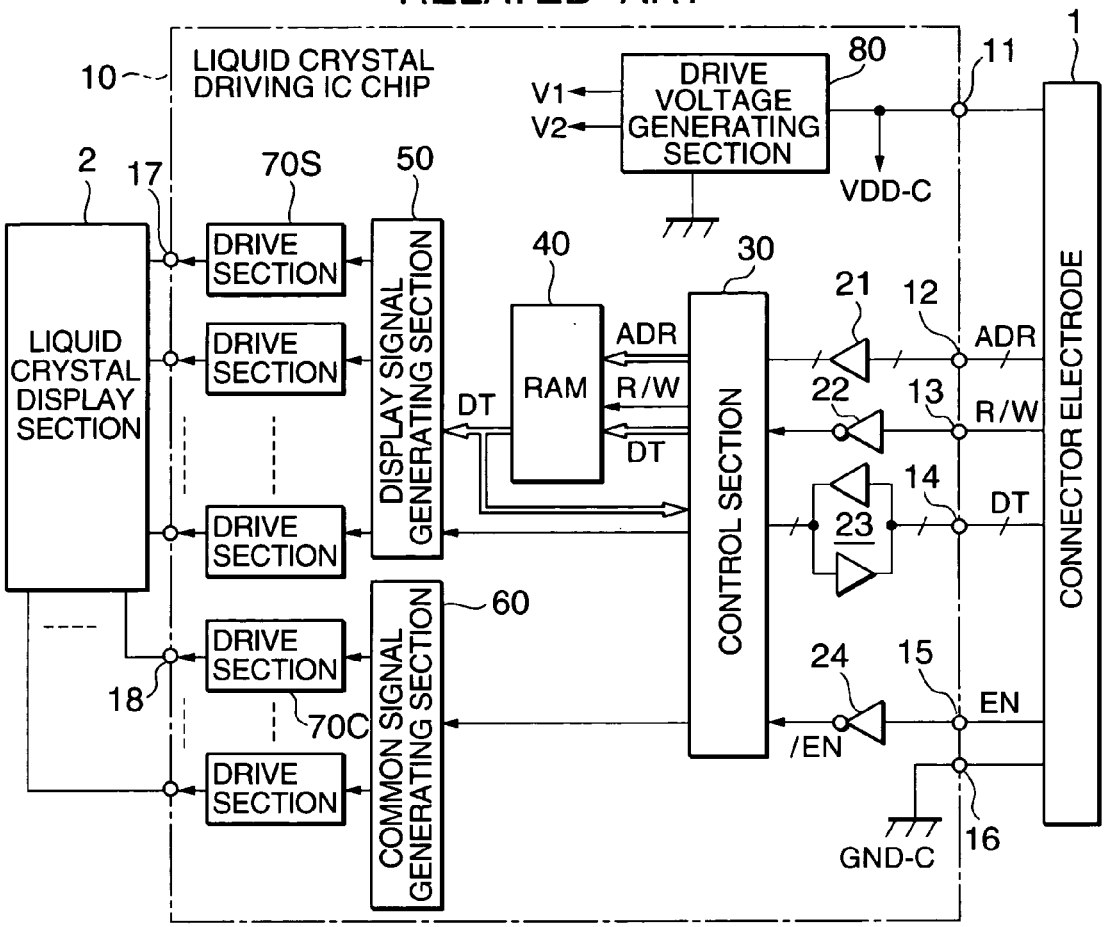
Fig. 2a RELATED ART
FIGS. 2*a* and 2*b* are structural diagrams of a conventional liquid crystal driving IC chip.
Figure 2B:
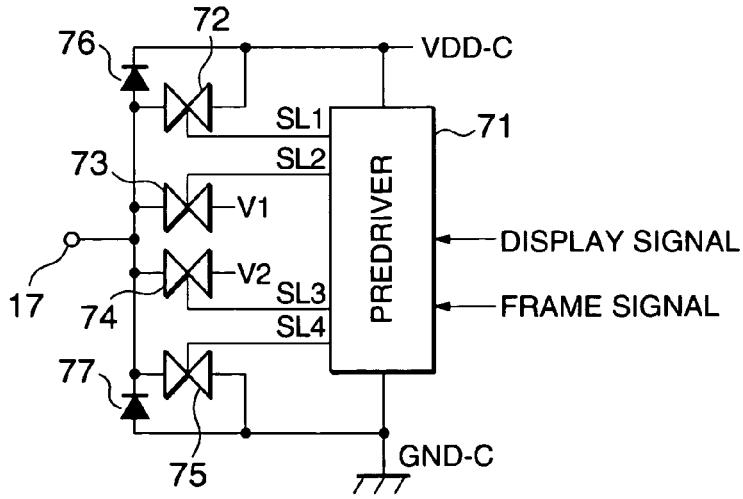
Fig. 2b RELATED ART
Figure 3:
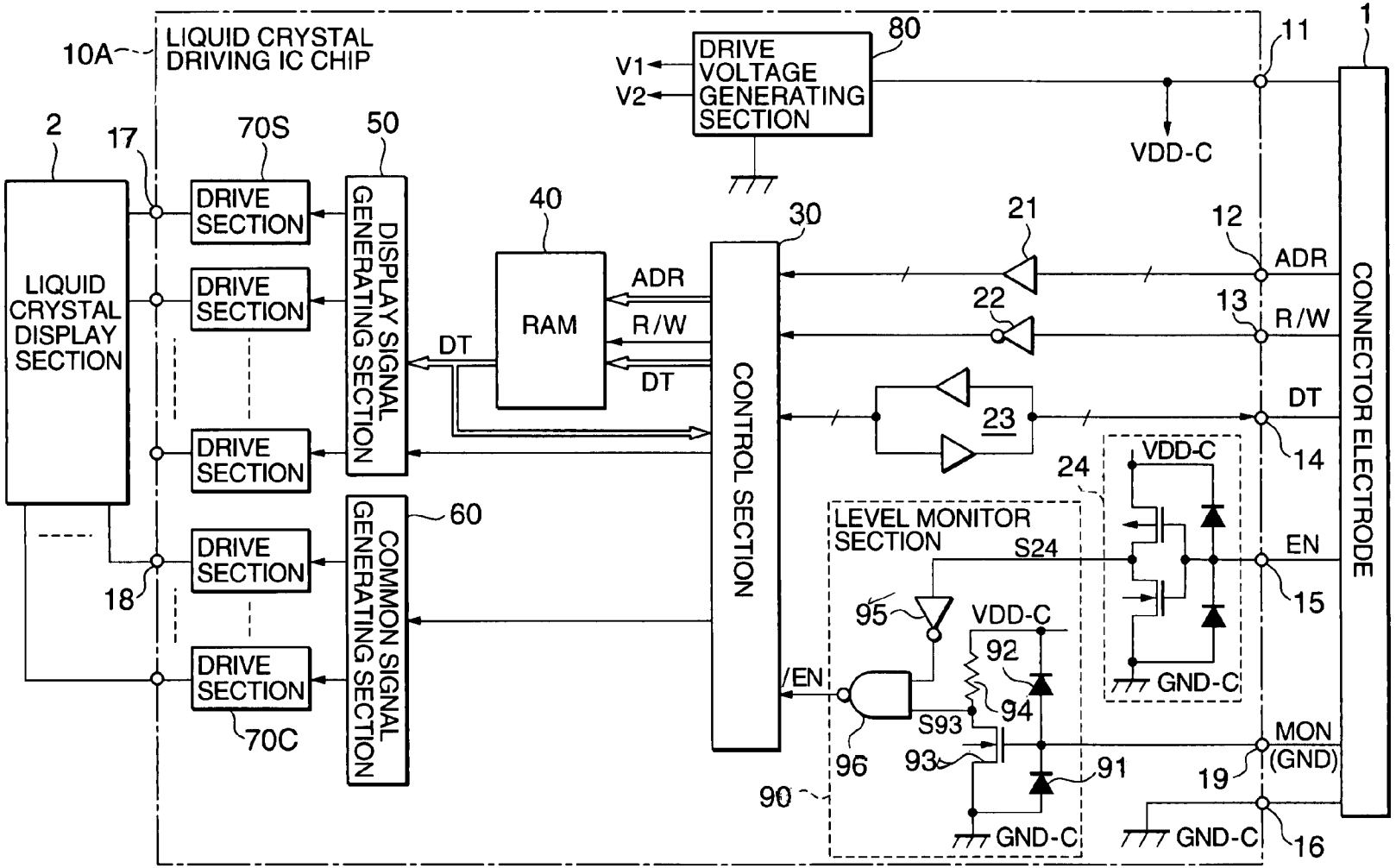
FIG. 3 is a structural diagram of a liquid crystal driving IC chip according to a first embodiment of the invention.

FIG. 3 is a structural diagram of a liquid crystal driving IC chip 10A according to the first embodiment of the invention and gives like or same reference numerals given to those components which are the same as the corresponding components in FIG. 2.

The liquid crystal driving IC chip 10A, like the liquid crystal driving IC chip 10 in FIG. 2, is to be mounted in the COG manner on, for example, the segment-side glass plate of an LCD. The IC chip 10A has a monitor electrode 19 in addition to a power-supply electrode 11 to connect to a connector electrode 1 formed on a segment-side glass plate, a plurality of address electrodes 12, a control electrode 13, a plurality of data electrodes 14, an enable electrode 15 and a ground electrode 16.

The power-supply electrode 11 is supplied with a power supply voltage VDD from the power supply circuit of an external computer or so. The address electrodes 12 are supplied with an address signal ADR from the computer for temporarily storage of display data. The control electrode 13 is supplied with a read/write control signal R/W from the computer. The data electrodes 14 are used to input and output a data signal DT to from the computer in parallel. The enable electrode 15 is supplied from the computer with an enable signal EN which has an "H" level to enable the operation and an "L" level to disable the operation. The ground electrode 16 is connected to a reference potential for the computer, i.e., a ground potential GND.

The monitor electrode 19, as separate from the ground electrode 16, receives the ground potential GND on the computer side as a monitor signal MON in a path where the power supply current does not flow in order to monitor the ground potential GND-C of the IC chip 10A.

The IC chip 10A further has a plurality of drive electrodes 17 for outputting a display drive voltage to the individual segment electrodes of a liquid crystal display section 2 and a plurality of drive electrodes 18 for outputting a scan drive voltage to scan the common electrodes of the liquid crystal display section 2 sequentially.

The address electrodes 12, the control electrode 13 and the data electrodes 14 are connected to a control section 30, which controls the general operation of the IC chip 10A, via a buffer 21, a buffer inverter 22 and a bidirectional buffer 23, respectively. The monitor electrode 19 is connected to the level monitor section 90 to which the enable electrode 15 is connected via a CMOS inverter 24.

The level monitor section 90 comprises protective diodes 91 and 92, an N channel MOS transistor (hereinafter referred to as "NMOS") 93, a resistor 94, an inverter 95 and a not AND gate (hereinafter referred to as "NAND") 96. The monitor electrode 19 is connected to the ground potential GND-C and the power supply voltage VDD-C in the reverse directions by the protective diodes 91 and 92, respectively, and is connected to the gate of the NMOS 93.

The source of the NMOS 93 is connected to the ground potential GND-C, while the drain of the NMOS 93 connected to the power supply voltage VDD-C via the resistor 94 and further connected to the first input side of the NAND 96. An output signal S24 of the CMOS inverter 24 is inverted by the inverter 95 and is then given to the second input side of the NAND 96. An enable signal /EN is output from the output side of the NAND 96 to the control section 30.

The other structure is the same as the corresponding structure in FIG. 2.

Specifically, a RAM 40 which stores display data is connected to the control section 30. A display signal generating section 50 which generates display signals corresponding to the individual segment electrodes of the liquid crystal display section 2 is connected to the data output side of the RAM 40. Also connected to the control section 30 is a common signal generating section 60 which generates a common signal to scan the connector electrodes of the liquid crystal display section 2 sequentially. The output side of the display signal generating section 50 is connected to the drive electrodes 17 via a plurality of drive sections 70S which generate display drive voltages, based on the display signals, to drive the respective segment electrodes in the AC manner. The output side of the common signal generating section 60 is connected to the drive electrodes 18 via a plurality of drive sections 70C which generate display drive voltages, based on the display signals, to drive the respective common electrodes in the AC manner. Further, the IC chip 10A has a drive voltage generating section 80 which generates drive voltages V1 and V2 for AC-driving the liquid crystal display section 2 from a chip power supply voltage VDD-C supplied from the connector electrode 1. The drive voltages V1 and V2 are commonly supplied to the individual drive sections 70S and 70C.

Figure 1:
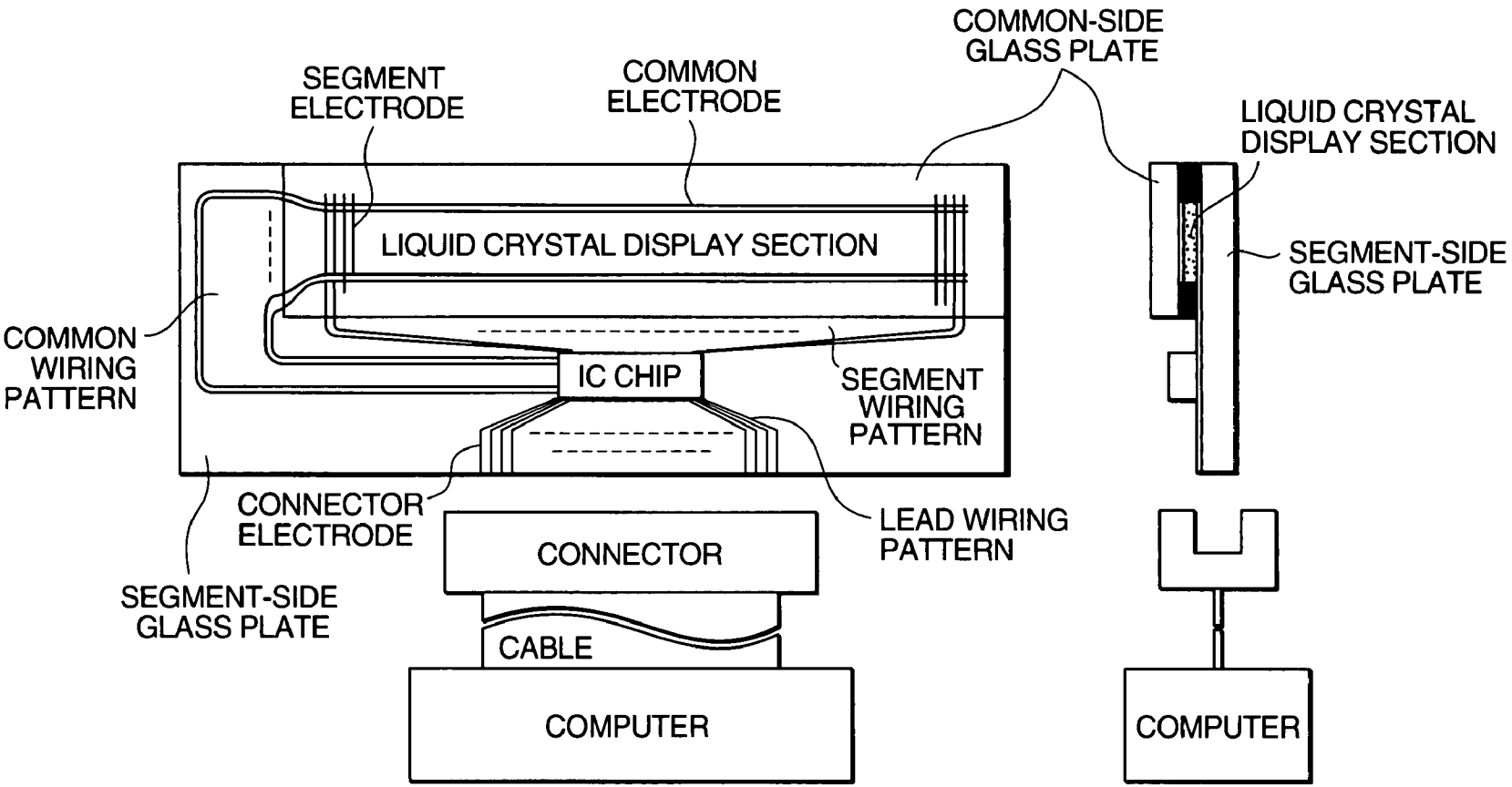
Fig. 1 RELATED ART
FIG. 1 is a conceptual diagram of a COG type LCD.

The individual electrodes 11 to 16 and 19 of the IC chip 10A are connected to the connector electrode 1 via the lead wiring pattern formed on the segment-side glass plate as shown in FIG. 2. The individual electrodes 17 and 18 are connected to the liquid crystal display section 2 via the segment wiring pattern and a common wiring pattern both formed on the segment-side glass plate as shown in FIG. 1.

Next, the operation of the IC chip 10A is described, an operation in normal state where there is no electrostatic surge and an operation when an electrostatic surge is applied, separately.

(1) Operation in Normal State

First, as the power supply voltage VDD is supplied to the power-supply electrode 11 of the IC chip 10A via the connector electrode 1 and the ground electrode 16 is connected to the ground potential GND, the power supply voltage VDD-C and the ground potential GND-C are given to the individual sections of the IC chip 10A. Then, the drive voltage generating section 80 generates the drive voltages V1 and V2 and supplies the voltages to the individual drive sections 70S and 70C.

At this time, the power supply current flows to the lead wiring patterns that connect the power-supply electrode 11 and ground electrode 16 to the connector electrode 1 and those lead wiring patterns cause voltage drops. As the power supply current has a small value, however, the difference between the voltage drops is small. Further, the voltage drops cause the power supply voltage VDD-C to fall below the power supply voltage VDD of the external power supply circuit, but cause the ground potential GND-C to rise above the external ground potential GND. Accordingly, the threshold voltage of the CMOS or so hardly changes, raising no operational problem.

As the ground potential GND is given to the monitor electrode 19 from the external computer, the NMOS 93 of the level monitor section 90 is turned off so that a signal S93 at the drain of the NMOS 93 goes to "H". As a result, the signal S24 output from the CMOS inverter 24 is inverted twice by the inverter 95 and the NAND 96, respectively, and is output to the control section 30 as the enable signal /EN from the NAND 96. Therefore, the subsequent operation in the normal state is the same as has been discussed in the Description of the Related Art.

(2) Operation when Electrostatic Surge is Applied

Figure 4:
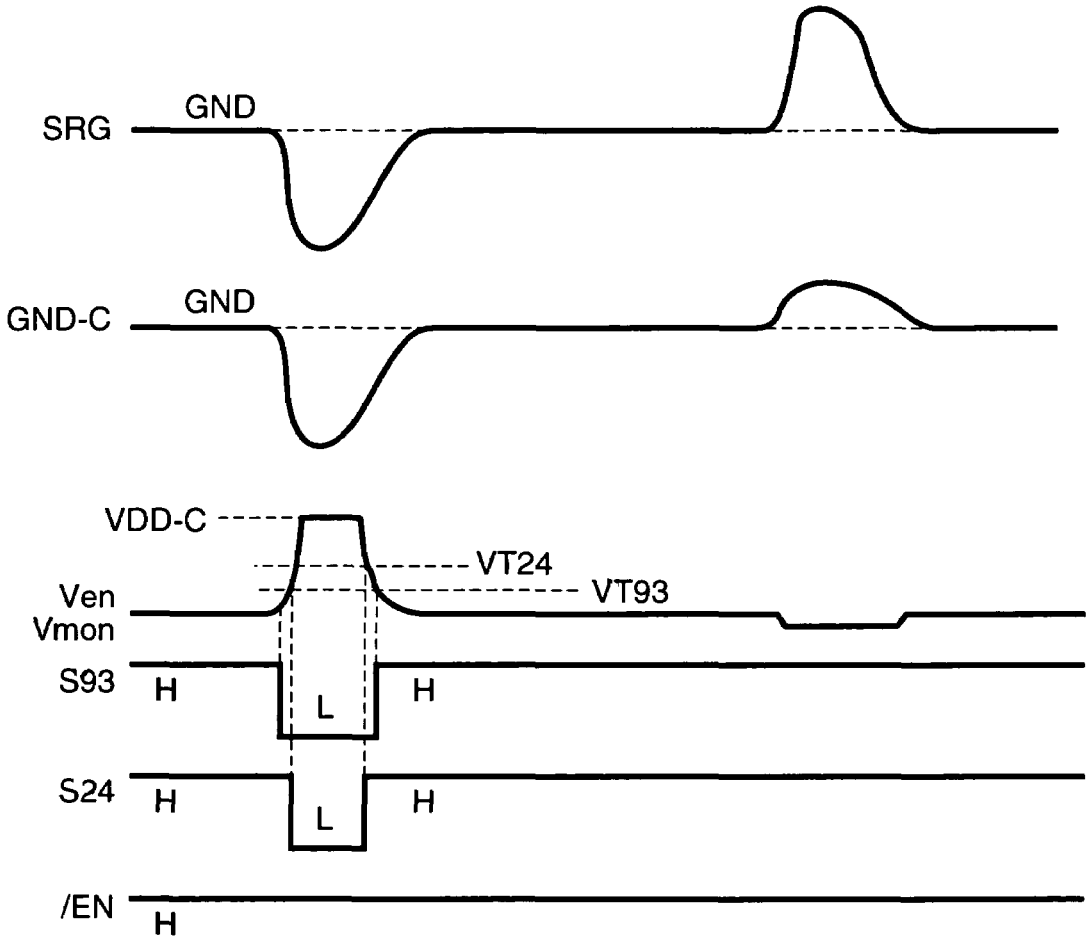
FIG. 4 is a signal waveform diagram showing the operation of the IC chip when an electrostatic surge penetrates.

FIG. 4 is a signal waveform diagram showing the operation of the IC chip 10A in FIG. 3 when an electrostatic surge penetrates.

When a finger or so carrying static electricity touches the glass plate of the liquid crystal display section 2, for example, an electrostatic surge SRG is applied to the segment electrodes or so via the glass plate. The applied electrostatic surge SRG is transmitted to the drive electrodes 17 of the IC chip 10A through the segment wiring pattern on the top surface of the segment-side glass plate and then penetrates the drive sections 70S.

In case where the electrostatic surge SRG has a negative polarity, a surge current flows to the finger or so from the ground potential GND of the external computer through the connector electrode 1, the lead wiring patterns on the segment-side glass plate, the ground electrode 16, the protective diode 77 in the drive section 70 and the segment wiring pattern.

The surge current causes a voltage drop in the lead wiring pattern so that the ground potential GND-C of the IC chip 10A becomes lower than the ground potential GND of the external computer. Meanwhile, the surge current does not flow to both the lead wiring patterns that connect the enable electrode 15 and the monitor electrode 19 to the connector electrode 1. Therefore, the level of the signal of the enable electrode 15 is nearly the same as the level of the enable signal EN which is output from the external computer. The signal level of the monitor electrode 19 is the same as the ground potential GND of the external computer. Therefore, a voltage Ven of the enable electrode 15 with the internal ground potential GND-C as a reference and a voltage Vmon of the monitor electrode 19 rise as the surge current causes the ground potential GND-C to drop. As the protective diodes are provided on the input sides of the CMOS inverter 24 and the level monitor section 90, a voltage rise above the voltage that is the forward voltage of the protective diodes added to the internal power supply voltage VDD-C is suppressed.

While the voltages Ven and Vmon both rise due to the negative electrostatic surge SRG, a threshold voltage VT93 of the NMOS 93 in the level monitor section 90 is lower than a threshold voltage VT24 of the CMOS inverter 24. Therefore, the NMOS 93 is turned on first and its output signal S93 becomes "L" after which the output signal S24 of the CMOS inverter 24 becomes "L".

Thereafter, as the surge current decreases and the voltages Ven and Vmon gradually drop, the output signal S24 of the CMOS inverter 24 returns "H" first after which the NMOS 93 which has a lower threshold voltage is turned off and its output signal S93 returns to "H". Therefore, the enable signal /EN to be output to the control section 30 from the level monitor section 90 is not influenced by the negative electrostatic surge.

In case where the electrostatic surge SRG is positive, the surge current flows from the finger or so to the power supply voltage VDD of the external computer via the segment wiring pattern, the protective diode 76 in the drive section 70, the power-supply electrode 11, the lead wiring patterns on the segment-side glass plate and the connector electrode 1. This causes the internal power supply voltage VDD-C to rise, and the ground potential GND-C rises accordingly. As the surge current does not flow to both the lead wiring patterns that connect the enable electrode 15 and the monitor electrode 19 to the connector electrode 1, therefore, the voltage Ven of the enable electrode 15 with the internal ground potential GND-C as a reference and the voltage Vmon of the monitor electrode 19 fall as the surge current causes the ground potential GND-C to increase. As the protective diodes are provided on the input sides of the CMOS inverter 24 and the level monitor section 90, a voltage drop below the forward voltage of the protective diodes is suppressed. Therefore, the enable signal /EN to be output to the control section 30 from the level monitor section 90 is not influenced by the positive electrostatic surge.

As described above, the liquid crystal driving IC chip 10A according to the first embodiment is provided with the NMOS 93 that has a lower threshold voltage than that of the CMOS inverter 24 which detects the enable signal EN, detects a variation in the ground potential GND of the external power supply circuit by means of the NMOS 93 and masks the detection signal from the CMOS inverter 24 with the detection signal from the NMOS 93. The IC chip 10A therefore has an advantage such that even when the ground potential GND-C of the IC chip 10A is changed by the electrostatic surge, the enable signal EN is not erroneously detected and an electrostatic-surge originated malfunction can be prevented.

(Second Embodiment)

Figure 5:
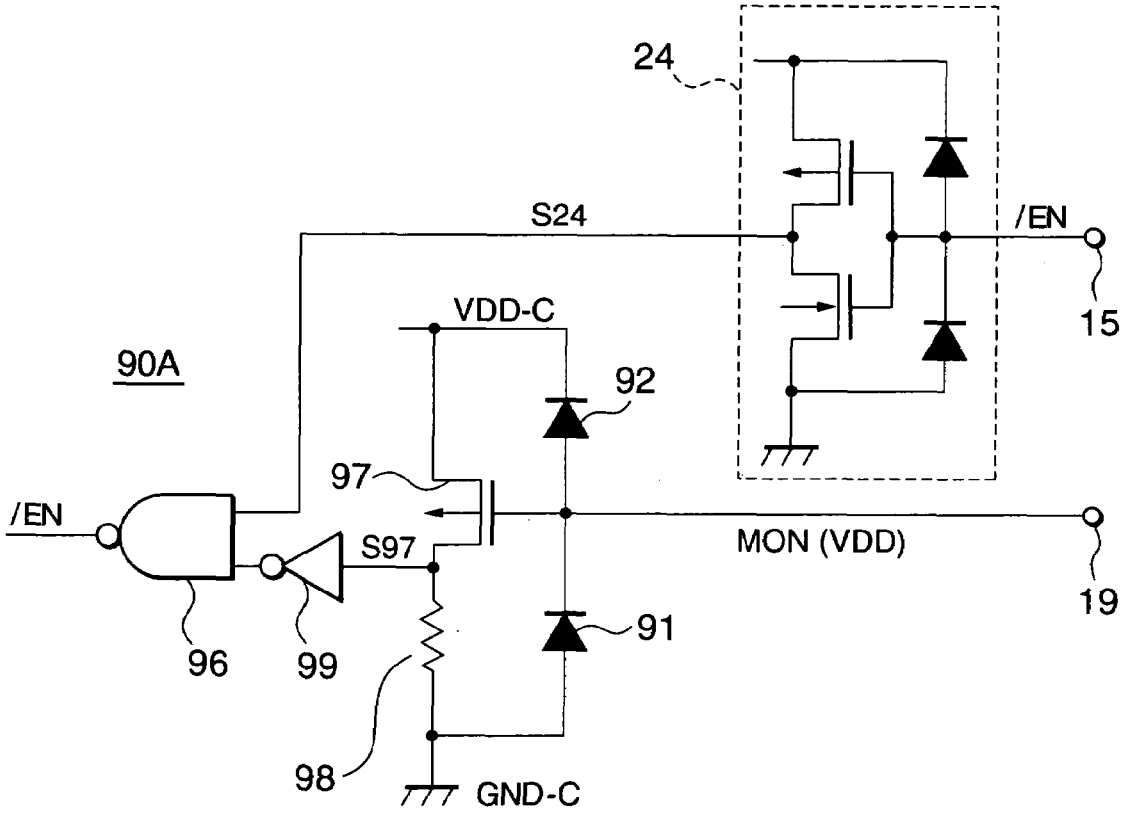
FIG. 5 is a structural diagram of a level monitor section according to a second embodiment of the invention.

FIG. 5 is a structural diagram of a level monitor section 90A according to the second embodiment of the invention and gives like or same reference numerals given to those components which are the same as the corresponding components in FIG. 3.

This level monitor section 90A is provided in place of the level monitor section 90 when an enable signal /EN with an inverted logical level (which becomes "L" to enable the operation and "H" to disable the operation) is used as a signal to be given to the enable electrode 15 of the liquid crystal driving IC chip 10A in FIG. 3.

The CMOS inverter 24 is supplied with the enable signal /EN from the enable electrode 15. The monitor electrode 19 is supplied with the power supply voltage VDD of the power supply circuit of a computer or so in a path where the power supply current does not flow, in order to monitor the power supply voltage VDD-C in the IC chip.

The level monitor section 90A comprises the protective diodes 91 and 92, a P channel MOS transistor (hereinafter referred to as "PMOS") 97, a resistor 98, an inverter 99 and the NAND 96. The monitor electrode 19 is connected to the ground potential GND-C and the power supply voltage VDD-C in the reverse directions by the protective diodes 91 and 92, respectively, and is connected to the gate of the PMOS 97.

The source of the PMOS 97 is connected to the power supply voltage VDD-C while the drain of the PMOS 97 is connected to the ground potential GND-C via the resistor 98 and further connected to the first input side of the NAND 96 via the inverter 99. The output signal S24 of the CMOS inverter 24 is given to the second input side of the NAND 96. The enable signal /EN is output from the output side of the NAND 96 to the control section 30.

In the level monitor section 90A in the normal state where there is no electrostatic surge, the PMOS 97 is turned off and a signal S97 to be output from the drain of the PMOS 97 becomes "L". The signal S7 is inverted by the inverter 99 to become "H" and is then supplied to the first input side of the NAND 96. Therefore, the enable signal /EN having the same logical level as that of the enable signal given to the enable electrode 15 is output from the output side of the NAND 96.

When a positive electrostatic surge SRG is applied, on the other hand, the power supply voltage VDD-C in the IC chip rises, causing the levels of the enable signal /EN of the enable electrode 15 and the monitor signal MON of the monitor electrode 19 come lower than the power supply voltage VDD-C. In this case, the PMOS 97 which has a higher threshold voltage is turned on first, setting the signal S97 to "H", so that the output signal S24 of the CMOS inverter 24 is masked by the NAND 96 whose enable signal /EN is kept at "H".

With regard to the negative electrostatic surge SRG, an erroneous enable signal /EN is not output and an electrostatic-surge originated malfunction does not occur.

As described above, the level monitor section 90A according to the second embodiment is provided with the PMOS 97 that has a higher threshold voltage than that of the CMOS inverter 24 which detects the enable signal /EN, detects a variation in the power supply voltage VDD of the external power supply circuit by means of the PMOS 97 and masks the detection signal from the CMOS inverter 24 with the detection signal from the PMOS 97. The embodiment therefore has an advantage such that even when the power supply voltage VDD-C of the IC chip varies due to the electrostatic surge, the enable signal /EN is not erroneously detected and an electrostatic-surge originated malfunction can be prevented.

(Third Embodiment)

Figure 6:
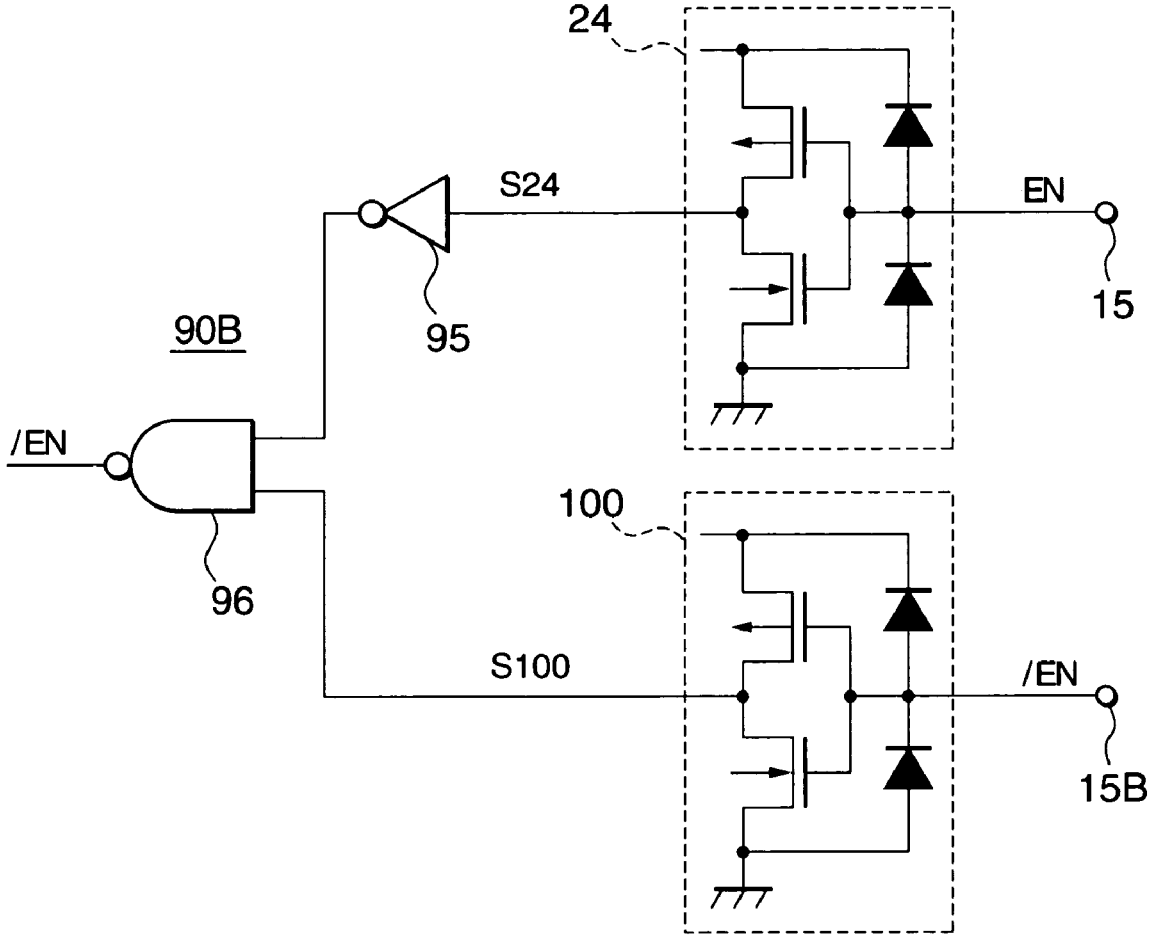
FIG. 6 is a structural diagram of a level monitor section according to a third embodiment of the invention.

FIG. 6 is a structural diagram of a level monitor section 90B according to the third embodiment of the invention and gives like or same reference numerals given to those components which are the same as the corresponding components in FIG. 3.

The level monitor section 90B is provided with an enable electrode 15B, which is supplied with the enable signal /EN with an inverted logical level from an external computer or so, in place of the monitor electrode 19 of the IC chip 10A in FIG. 3. The level monitor section 90B comprises the inverter 95, the NAND 96 and a CMOS inverter 100. The enable electrode 15B is connected to the input side of the CMOS inverter 100 similar to the CMOS inverter 24, and the output side of the CMOS inverter 100 is connected to the first input side of the NAND 96. The output signal S24 of the CMOS inverter 24, like the one shown in FIG. 3, is inverted by the inverter 95 and is then supplied to the second input side of the NAND 96.

In the level monitor section 90B in the normal state where there is no electrostatic surge, complementary enable signals EN and /EN are respectively supplied to the enable electrodes 15 and 15B. The enable signal /EN is inverted by the CMOS inverter 100 and is then supplied to the first input side of the NAND 96, while the enable signal EN is inverted twice by the inverters 24 and 95 and is then supplied to the second input side of the NAND 96. Therefore, the enable signal /EN is output from the NAND 96.

When a positive electrostatic surge SRG is applied, the power supply voltage VDD-C in the IC chip rises, so that even when the enable signal /EN of the enable electrode 15B has an "H" level, an output signal S100 with an "H" level may be output from the CMOS inverter 100. Because the enable signal EN with an "L" level to be given to the CMOS inverter 24 from the enable electrode 15 is not influenced by a rise in power supply voltage VDD, however, the output signal S24 of the CMOS inverter 24 is at "H". Therefore, the enable signal /EN to be output from the NAND 96 is kept at "H".

When a negative electrostatic surge SRG is applied, on the other hand, the ground potential GND-C in the IC chip falls, so that even when the enable signal EN of the enable electrode 15 has an "L" level, the output signal S24 with an "L" level may be output from the CMOS inverter 24. Because the enable signal /EN with an "H" level to be given to the CMOS inverter 100 from the enable electrode 15B is not influenced by a fall in ground potential GND-C, however, the output signal S100 of the CMOS inverter 100 is at "L". Therefore, the enable signal /EN to be output from the NAND 96 is kept at "H".

As described above, the level monitor section 90B according to the third embodiment is provided with the CMOS inverter 100 which detects the enable signal /EN complement to the enable signal EN in addition to the CMOS inverter 24 which detects the enable signal EN, and generates an enable signal to be used in the actual control in accordance with the logical product of the enable signals detected by the CMOS inverters 24 and 100. The embodiment therefore has an advantage such that even when the power supply voltage VDD-C and ground potential GND-C of the liquid crystal driving IC chip vary due to the positive and negative electrostatic surges, an erroneous enable signal is not output, thereby preventing an electrostatic-surge originated malfunction.

The above-described embodiments have been given to make the technical contents of the invention clear. The invention should not be considered restrictive to the embodiments but can be worked out in various modifications within the scope of the appended claims. The following are some of the modifications.

(a) The general structure of the liquid crystal driving IC chip 10A shown in FIG. 3 is just one example, and the invention can be adapted to IC chips with other structures, e.g., an IC chip which does not have capability of reading data from a RAM and send it to an external unit.

(b) The logical gate structures constituted by the inverters and NANDs of the level monitor sections 90, 90A and 90B are illustrative and can be achieved by other circuits having similar functions.

What is claimed is:

1. A liquid crystal driving semiconductor chip comprising:

a control section which stores display data into a memory section in accordance with an operation control signal;

a drive section which drives a liquid crystal display in accordance with said display data stored in said memory section;

a power-supply electrode to which power is supplied from an external power supply circuit;

a monitor electrode which is supplied with a power supply potential of said power supply circuit in a path different from a path for said power supplied from said power supply circuit;

a control electrode to be supplied with a control signal to enable an operation of said control section;

a CMOS inverter which detects a logical level of said control signal to be supplied to said control electrode; and a level monitor section which has an MOS transistor for detecting a logical level of said power supply potential to be supplied to said monitor electrode, outputs a detection signal from said CMOS inverter to said control section as said operation control signal when said MOS transistor detects a correct logical level, and stops outputting said operation control signal when said MOS transistor does not detect the correct logical level.

2. The liquid crystal driving semiconductor chip according to claim 1, wherein said power supply potential to be supplied to said monitor electrode is a positive potential and said MOS transistor is an N type transistor.

3. The liquid crystal driving semiconductor chip according to claim 1, wherein said power supply potential to be supplied to said monitor electrode is a negative potential and said MOS transistor is a P type transistor.

4. A liquid crystal driving semiconductor chip comprising:

a control section which stores display data into a memory section in accordance with an operation control signal;

a drive section which drives a liquid crystal display in accordance with said display data stored in said memory section;

a first control electrode to be supplied with a first control signal to enable an operation of said control section;

a second control electrode to be supplied with a second control signal whose logical level is an inverted logical level of said first control signal;

a first CMOS inverter which detects a logical level of said first control signal to be supplied to said first control electrode; and a level monitor section which has a second CMOS inverter which detects a logical level of said second control signal to be supplied to said second control electrode, outputs a detection signal from said first CMOS inverter to said control section as said operation control signal when a logical level of a signal obtained by inverting a detection signal from said first CMOS inverter coincides with a logical level of a detection signal from said second CMOS inverter, and stops outputting said operation control signal when said logical levels do not match with each other.

* * * * *